US005416932A

United States Patent [19]

Ventrice

[11] Patent Number: 5,416,932

[45] Date of Patent: May 23, 1995

[54] SWIMMING POOL WITH LINER PORTHOLE

[76] Inventor: Raymond J. Ventrice, 24 Autumn Dr., Basking Ridge, N.J. 07920

[21] Appl. No.: 253,318

[22] Filed: Jun. 3, 1994

[51] Int. Cl.[6] ..... E04H 4/14

[52] U.S. Cl. ..... 4/496; 4/506

[58] Field of Search ..... 4/488, 494, 496, 506, 4/904, 585; 435/254; 220/403, 662, 663

[56] References Cited

U.S. PATENT DOCUMENTS

| | | | |
|---|---|---|---|
| 1,921,230 | 8/1933 | Hunter | 4/496 |
| 3,167,209 | 10/1965 | Jones | 220/403 X |
| 3,555,575 | 1/1971 | Schwarz et al. | 4/506 |
| 3,562,822 | 2/1971 | Wall | 4/506 |
| 4,886,164 | 12/1989 | Stein et al. | 220/403 X |

FOREIGN PATENT DOCUMENTS

| | | | |
|---|---|---|---|
| 2039216 | 8/1980 | United Kingdom | 4/488 |

*Primary Examiner*—Robert M. Fetsuga
*Attorney, Agent, or Firm*—William T. Hough

[57] ABSTRACT

An above-ground outdoor circular swimming pool having the typical outer circumscribing support walls with a through-space as symbolic porthole-like window there is placed within space circumscribed by the outer circumscribing support walls, a water-retaining translucent or transparent liner mounted at and suspended circumscribingly from upper securing structure at the top of the circumscribing support walls. Thereby the secured and suspended transparent liner wall when containing water is pressed toward the porthole-like window, such that there is provided a line-of-sight view from each of the inside and the outside through the transparent liner. The liner itself if sufficiently rigid or sturdy in part or in whole, and/or alternatively a separate supporting transparent sheet-like transparent rigid and sturdy solid and/or mesh structure overlaps the through-space.

18 Claims, 5 Drawing Sheets

FIG. 4A
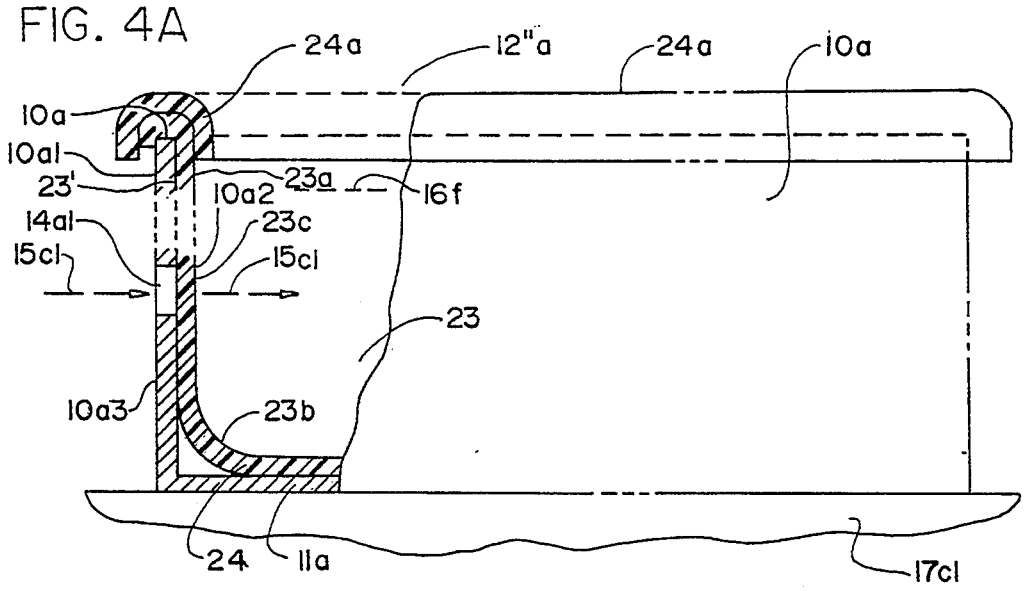
FIG. 4B
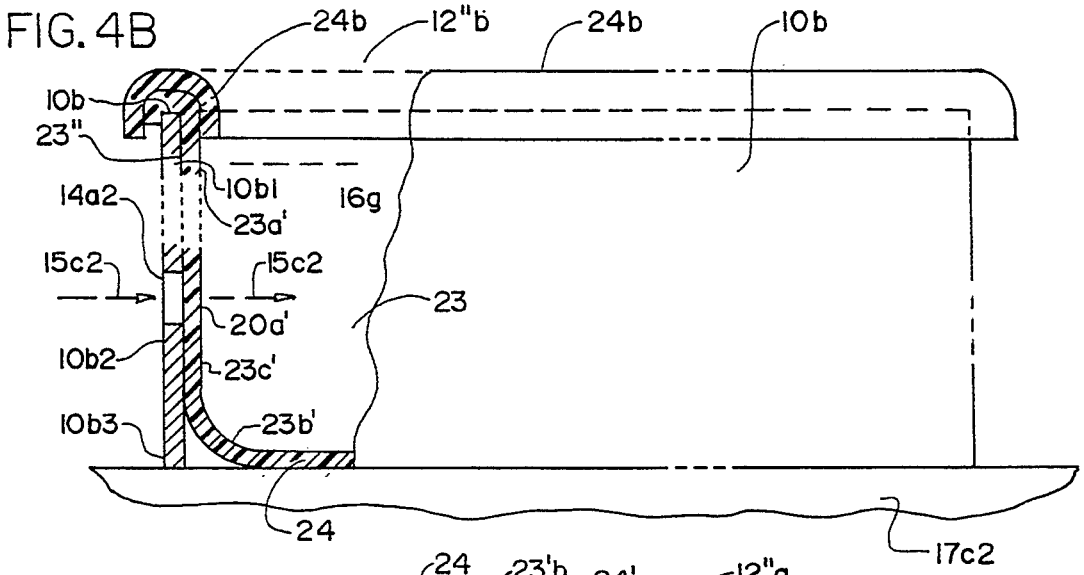
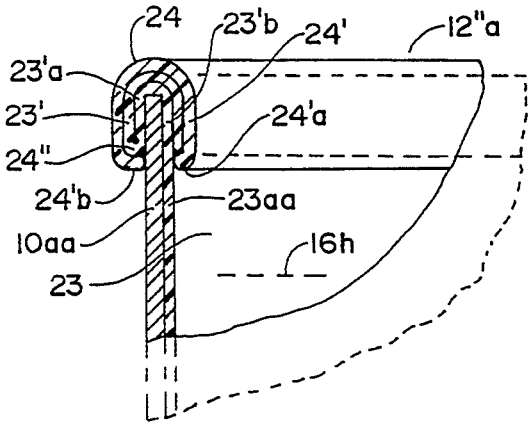
FIG. 5

SWIMMING POOL WITH LINER PORTHOLE

This invention pertains to typically above-ground circular swimming pools having a viewing port or window in the rigid outer frame, for viewing interior water within.

PRIOR ART

No relevant technology known to exist prior to the invention, a prior art search was conducted in the United States Patent & Trademark Office Class 4, subclasses 506, 494, 496 and 488. No relevant patents were located, patents of mere interest being Brooks U.S. Pat. No. 3,373,450 issued Mar. 19, 1968, and Garate U.S. Pat. No. 2,875,528. The Brooks U.S. Pat. No. 3,373,450 illustrates a tank-type pool having a conventional window constructed into the side thereof below typical inside normal water level thereof, the window being an intergral water-retaining part of the tank side itself. The Garate patent typically shows in its FIGS. 1 and 6 an instructional tank-type pool having four windows 12 and 13 all below inside water level, each window inclusive of glass compressed by a frame element with a compressed inner and outer gaskets, secured by bolts. These patents represent the conventional state of the prior art for such windows constructed into the circumscribing side wall of a window through-space, with the inside surfaces of the windows in contact with the tank pool contained water.

BACKGROUND

Prior to the present invention, there have existed windows sealably constructed by use of sealing rings, with bolted structure compressing the glass and compressible sealing gaskets for sealing the heretofore window glass onto the side support walls of the water-containing tank. Such arrangements have been plagued by occurances and reoccurances of leaks, together with a high cost of excessive time required in the construction and/or installation thereof.

OBJECTS

Accordingly, objects of the invention include the obtaining of an alternative water-retaining pool construction inclusive below water-level window(s) devoid of problems of potential and/or actual water leakage.

Another object is to provide an economically inexpensive alternative windowed pool construction devoid of window structures having to use the heretofore prior art compressible seals and mounting bolts, nuts and the like.

Another object is to provide a novel water-retaining pool combination that includes below-water window(s) through which below water activity within the pool may be view through the windows thereof from a location adjacent the pool outside of the window(s).

Other objects become apparent from the preceding and following disclosure.

BROAD DESCRIPTION

The invention is inclusive of and directed to any liquid containing structure utilized or utilizable for the containing of any liquid such as water or gasoline or oil of any of diverse liquid chemicals, for the combination and improvement thereof described below. A particular useful area and combination is that of an above-ground swimming pool structures.

Accordingly, in a swimming pool embodiment, there is the prior art combination of broadly: A) upright substantially rigid wall, and B) water containable vessel liner, taken in combination with an improvement subcombination.

In greater detail, the upright substantially rigid wall(s) a) extend above ground level with the upright walls at least substantially circumscribing pool water retainable liner-space, b) have upper portions, c) have the swimming pool water containable vessel liner securing structure (and mechanism thereof) such that it anchors upper circumscribing portions of a swimming pool water-retainable liner at the wall upper portions of the upright walls, and d) the aforestated rigid wall(s) include at-least one through-space window-like opening through the walls with the at-least one through-space window-like opening. The swimming pool water-retainable liner a) has a bottom portion and b) has a circumscribing liner wall that is substantially uprightly extendable with (i) a liner lower wall portion thereof continuous with the bottom portion, (ii) a liner upper portion thereof securable by the water containable vessel liner securing means such that the uprightly extendable circumscribing liner wall is supported at a height above a predetermined intended water level containable within the water containable vessel liner, and (iii) an intermediate liner wall portion between the liner lower wall portion and the liner upper portion.

The aforestated improvement as a subcombination includes at-least each and all of the following. At-least a part of the intermediate liner wall portion is at-least one of transparent and translucent, and the through-space window-like opening is positionable to be alignable with the part at a predetermined elevation such that there exists a line of sight through both of the through-space window-like opening and the part.

In a first preferred embodiment as an improvement on the preceding broadly described invention, the part is of a shape and is of an area substantially the same as the through-space window-like opening.

In a second preferred embodiment as an improvement on the preceding broadly described invention, the aforestated part includes at-least a major proportion of the intermediate liner wall portion being at-least one of transparent and translucent.

In a third preferred embodiment as an improvement on the preceding broadly described invention, the aforestated each of the part and the through-space window-like opening are shaped substantially as a ship porthole.

In a fourth preferred embodiment as a further improvement on third embodiment, the aforestated part is transparent.

In a fifth preferred embodiment as a further improvement on the third embodiment, the aforestated part is translucent.

In a sixth preferred embodiment as a further improvement on the third embodiment, there is included at least one of a) framing structure and b) decorative matter on the intermediate liner wall portion at the aforestated through-space window-like opening, positioned and structured to impart an impression of and resemblance to a porthole.

In a seventh preferred embodiment as a further improvement on the third embodiment, in the rigid walls, the through-space window-like opening has at least one of a width and a diameter of at-least about one inch up to about forty-eight inches.

In an eighth preferred embodiment, as a further improvement on the broad generic invention as above initially described, in the rigid walls, the through-space window-like opening has at least one of a width and a diameter of at-least about one inch up to about forty-eight inches.

In a ninth preferred embodiment as an improvement on the eight preferred embodiment, in the rigid walls, the through-space window-like opening has at least one of a width and a diameter of about five inches up to about twenty-four inches.

In a tenth preferred embodiment as an improvement on the fourth preferred embodiment, in the rigid walls, the through-space window-like opening has at least one of a width and a diameter of at-least about one inch up to about forty-eight inches.

In an eleventh preferred embodiment as an improvement on the tenth preferred embodiment, in which in the rigid walls, the through-space window-like opening has at least one of a width and a diameter of about five inches up to about twenty-four inches.

In a twelfth preferred embodiment as an improvement on the broad generic invention as previously above-described, the aforestated part is transparent.

In a thirteenth preferred embodiment as an improvement on the broad generic invention as previously above-described, the aforestated part is translucent. In a fourteenth preferred embodiment as an improvement on the broad generic invention as previously above-described, there is included at least one of a) framing structure and b) decorative matter on the intermediate liner wall portion at the through-space window-like opening positioned and structured to impart a visual impression and resemblance of a ship's porthole.

In a fifteenth preferred embodiment as an improvement on the broad generic invention as previously above-described, there is included a see-through substantially rigid support structure positioned and mounted substantially flatly between the aforestated part and the rigid walls and in alignment with and over the through-space window-like opening such that support is provided sufficiently to avoid significant protrusion of the part through the through-space window-like opening when water is retained by the swimming pool liner.

In a sixteenth preferred embodiment as an improvement on the eleventh preferred embodiment, there is included a see-through substantially rigid support structure positioned and mounted substantially flatly between the part and the rigid walls and in alignment with and over the a through-space window-like opening such that support is provided sufficiently to avoid significant protrusion of the part through the through-space window-like opening when water is retained by the swimming pool liner.

Accordingly, in a liquid containable structure, there is the prior art combination of broadly: A) upright substantially rigid wall, and B) liquid containable vessel liner containable and retainable of any of a variety of alternate or combination(s) of liquids such as gasoline, oil, or any other natural and/or synthetic liquid, taken in combination with an improvement subcombination.

In greater detail of the alternate broader generic invention, the upright substantially rigid wall(s) a) extend above ground level with the upright walls at least substantially circumscribing liquid containable and retainable liner-defined space, b) have upper portions, c) the water containable and retainable vessel liner securing structure (and mechanism thereof) being such that it anchors upper circumscribing portions of a liquid containable and retainable liner at the wall upper portions of the upright walls, and d) the aforestated rigid wall(s) include at-least one through-space window-like opening through the walls with the at-least one through-space window-like opening. The liquid containable and retainable liner a) has a bottom portion and b) has a circumscribing liner wall that is substantially uprightly extendable with (i) a liner lower wall portion thereof continuous with the bottom portion, (ii) a liner upper portion thereof securable by the liquid containable and retainable liner securing means such that the uprightly extendable circumscribing liner wall is supported at a height above a predetermined intended liquid level containable within the liquid containable and retainable liner, and (iii) an intermediate liner wall portion between the liner lower wall portion and the liner upper portion.

In another alternate broader generic invention, there is a liquid containable and retainable liner suspendable within free space of at least one of a commercial storage tank providing elevated circumscribing support structure circumscribing the free space and a swimming pool. The commercial storage tank or the swimming pool, as the case may be, contains a see-through window space therein for viewing the free space or interior swimming pool space. The liquid containable and retainable liner a) has a bottom portion and b) has a circumscribing liner wall that is substantially uprightly extendable with:

(i) a liner lower wall portion thereof continuous with the bottom portion;

(ii) a liner upper portion thereof securable by elevated support structure such that said uprightly extendable circumscribing liner wall may be supported at a height above a predetermined intended liquid level containable within said liquid containable vessel liner, when the liquid containable and retainable liner is suspended within the free space; and (iii) an intermediate liner wall portion between the liner lower wall portion and the liner upper portion. At-least a part of the intermediate liner wall portion is at-least one of transparent and translucent. The through-space window-like opening is positionable to be alignable with the aforestated part at a predetermined elevation such that there exists a line of sight through both of the through-space window-like opening and the aforestated part. The liquid containable and retainable liner is anchorable at upper circumscribing portions of a liquid retaining vessel liner at said wall upper portions of the upright walls, when the liquid containable and retainable liner is suspended within said free space.

In a preferred embodiment of the immediately preceding liquid containable and retainable liner, the bottom is opaque.

In a further preferred embodiment as an improvement on the immediately preceding preferred embodiment, the aforestated part is a minor portion of the circumscribing liner wall.

The invention may be better understood by making reference to the drawings of the following Figures.

FIGURES

FIG. 1A diagrammatically and symbolically represents and illustrates an upright walled circular, cylindrical configuration, as typically representative of a prior art structure, such structure having an integral bottom, with regard to being retainable or containable of liquid such as water.

FIG. 1B diagrammatically and symbolically represents and illustrates an upright walled structure of circular, cylindrical configuration, as typically representative of a prior art structure, such structure being bottomless, with regard to being non-retainable or non-containable of liquid such as water.

FIGS. 2A and 2B each diagrammatically and symbolically represent and illustrate an in-part view of structures corresponding to those of FIGS. 1A and 1B, here having through-space cut-out window(s) positioned in the upright support wall(s) constituting an element of an embodiment of the present inventive combination(s).

FIGS. 3A, 3B and 3C each diagrammatically and symbolically represent and illustrate different alternative embodiments of liquid-containable or liquid retainable liner(s) with a see-through portion thereof, that constitute a second element of the present inventive combination, when used in combination with substantially upright circumscribing support wall of the type illustrated in either of FIGS. 2A and 2B, shown in partial cross-sectional view also illustrating line-of sight alignment of the through-space cut-out window(s) with the liquid-containable or liquid retainable liner(s)'s see-through portion.

FIG. 4A and 4B diagrammatically and symbolically represents and illustrates alternate preferred embodiments encompassing any one of the structures of FIGS. 2A and 2B with any one of the liners of FIGS. 3A, 3B and 3C.

FIG. 5 diagrammatically and symbolically represents and illustrates typical but not exclusive anchoring structure(s) by which the upper-most circumscribing portion(s) of any one of the liner(s) of FIGS. 3A, 3B and 3C is supported in its operative/functional position and state.

FIG. 6 diagrammatically and symbolically represents and illustrates for any one or more of the structures illustrated in FIGS. 2A and 2B, the typically structural and/or painted and/or applied printed appearance of the porthole preferred embodiment in combination, which circumscribes the through-space cut-out window(s), in an elevation plan view.

FIG. 7 diagrammatically and symbolically represents and illustrates an alternate preferred embodiment for a section of a tank wall otherwise corresponding to the disclosure of FIG. 4A, or to a support wall otherwise corresponding to the disclosure of FIG. 4B, shown in a side and top perspective view with a reenforcing transparent and/or translucent member adhered to an inner surface of the tank wall or of the support wall, to prevent the possibility of protrusion of a thinner liner also illustrated in-part, when water contained is sufficient to press the liner toward and against an inner surface of the tank wall or of the support wall.

FIG. 8 in an exploded view diagrammatically and symbolically illustrates an alternate preferred embodiment as compared to that of FIG. 7, in this embodiment, the transparent or translucent sturdy member being mounted on the liner surface and positioned such that it will be aligned with the through-space opening in the tank wall or support wall, such that any possibility of protrusion of the liner through the through-space opening is prevented.

FIG. 9 diagrammatically and symbolically illustrates and represents an additional preferred embodiment on any one or more of preceding embodiments, in which the outer surface of the tank or of the support wall, include actual structure and/or painted or otherwise symbolic structure resembling a ship's porthole circumscribing the through-space opening in the wall of the tank or of the support structure, as the case may be.

DETAILED DESCRIPTION

Figure 1A:
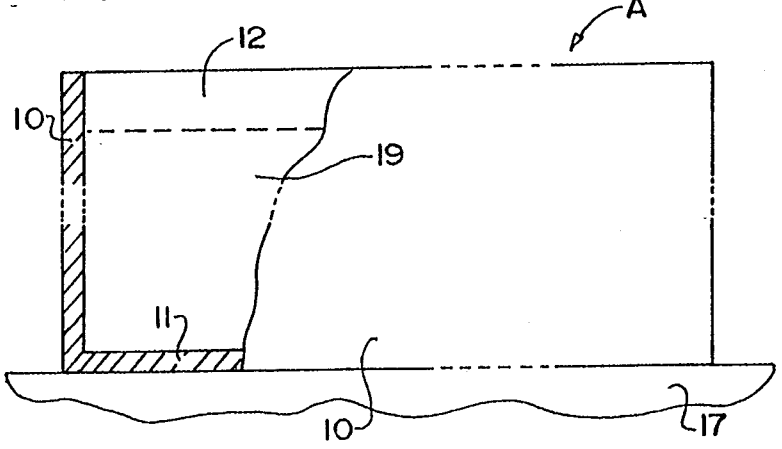
Figure 1B:
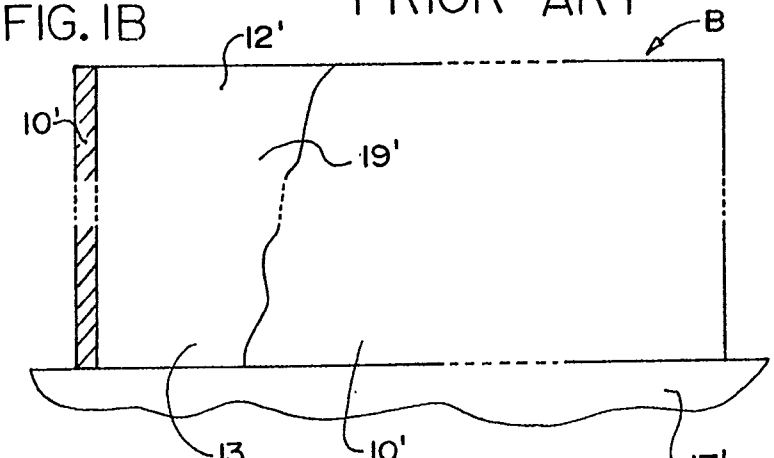

FIGS. 1A and 1B represent typical prior art structures A and B, the present invention modifying and a utilizing either of such structures or structural equivalents thereof.

More particularly FIG. 1A is a cut-away side view of a liquid retainable and/or containable metallic storage tank A having a bottom 11 with circumscribing walls 10 upwardly-extending therefrom to form upper opening 12, thereby being retainable and/or retainable of liquid 19. The tank 1A is normally supported above-ground level, supported by substrate 17.

FIG. 1B likewise shows a cut-away side view of space 19' circumscribed by upwardly extending normally metallic circumscribing walls 10' defining upper opening 12', cumulatively designated support structure B. The support structure B is typical of an outdoor above ground support structure for a liquid retainable liquid containable liner normally suspended on the circumscribing support walls 10' supported by substrate 17'. This structure normally has a bottom opening 13.

Figure 2A:
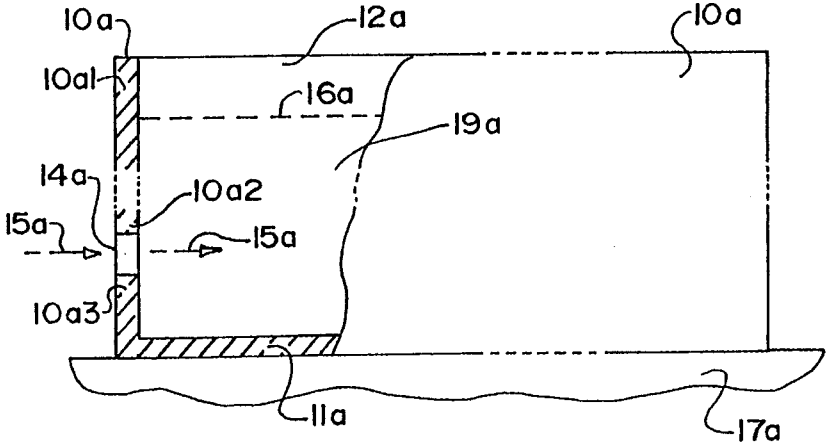
Figure 2B:
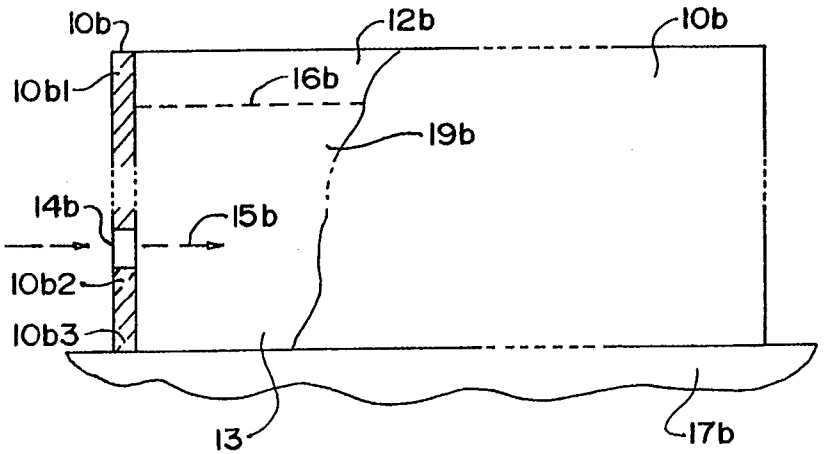

FIGS. 2A and 2B represent structures **10*a* and 10*b* corresponding to aforestated structures AA and B respectively, each modified to include a wall-located through-space)s) or window(s) 14*a* and 14*b* respectively. Tank 10*a* has upper wall 10*a'*, intermediate wall portion 10*a*2, and lower portion 10*a*3. The through-space 14*a* through intermediate wall portion 10*a*2 provides a line-of-sight linear path 15*a*, located below typical water level 16*a* with a pool liner contemplated to be suspended within space 19*a***. Each of modified tank 2A and modified support structure 2B are elements of a larger combination embodiment of the present invention.

Figure 3A:
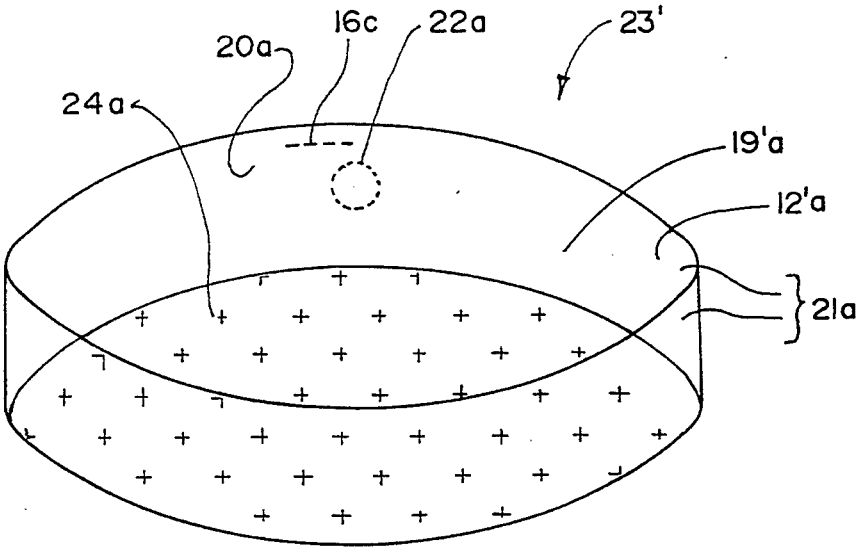
Figure 3B:
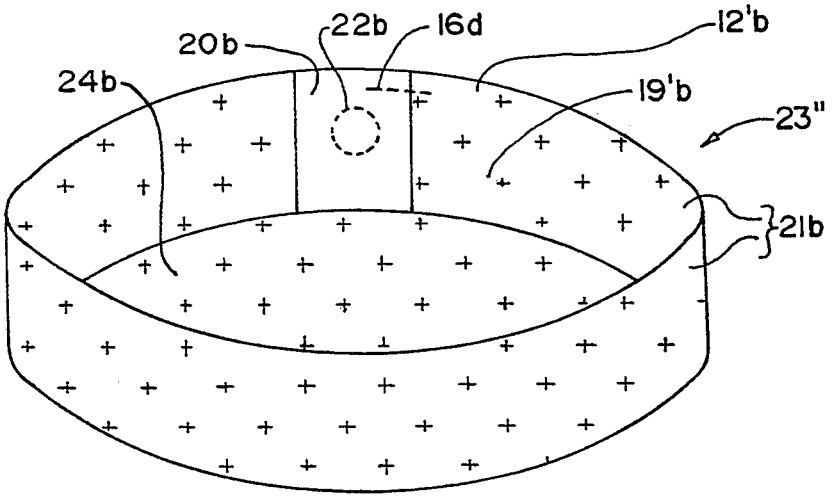
Figure 3C:
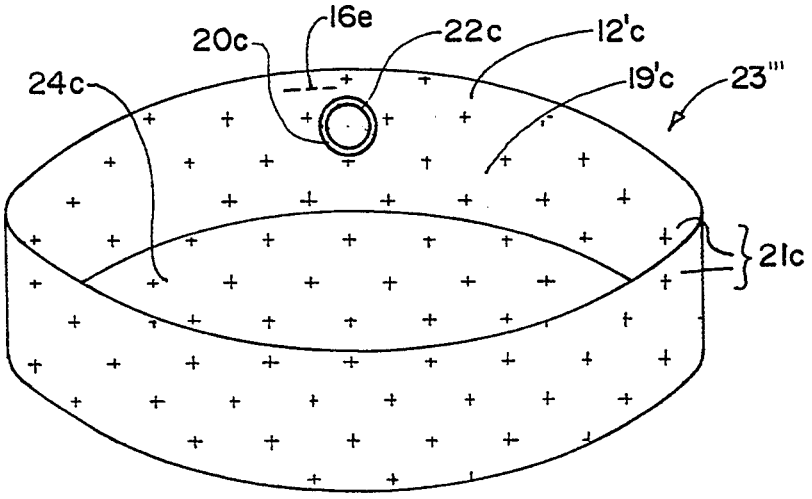

FIGS. 3A, 3B and 3C respectively illustrate alternate liquid retainable and containable liners 23', 23'' and 23''' of the present invention, the common features of the invention being the transparent and/or translucent wall portion **22*a* of liner 23', the transparent and/or translucent wall portion 22*b* of liner 23'', and the transparent and/or translucent wall portion 22*c* of liner '''. The inventive liner 23' has its entire (or substantially entire) substantially upright wall 21*a* being transparent and/or translucent, together with an opaque bottom portion 24*a*. In contrast, the inventive liner 23'' has a segment upright wall-portion 20*b* transparent and/or translucent, typically being fused to opaque remaining upright wall-portion 20*b*, together with a continuous opaque bottom 24*b*. In further contrast, the inventive liner 23''' has totally opaque wall 20*c* and bottom 24*c*, apart from the minor aforestated portion 20*c* the substantial entirety thereof being opaque. The minor portion 20*c* constituting constitutes a transparent or translucent window through the liner to be aligned in a line of sight alignment with the through-space opening in the tank wall or the support wall, as the case may be. The window-minor portion 20*c* is normally a fused, integral part of the liner, fused into a conforming opening in the opaque upright wall portion 20*c*, the substantial entirety thereof constituting the transparent or transparent window 22*c* and continuous with the opaque bottom 214*c*** and with the opaque wall 20*c*. In a preferred embodiment of any one of FIGS. 3A, 3B and 3C, the transparent and/or translucent wall portions 22*a*, 22*b* and 22*c*, and the immediately adjacent integral portion of the wall portion 20*a*, 20*b* and 20*c* are of sufficient rigidity and/or thickness as to prevent water pressure from causing the portion(s) 22*a*, 22*ba* and 22*c* from protruding through the through-spaces 14*a*1, 14*a*2 of the aforestated structures 10*a* and 10*b*.

FIGS. 4A and 4B illustrate the invention combination of any one of the lines 23′, 23″, or 23‴, shown herein as liner 23, in combination with either of the tank 10*a* or the support wall(s) 10*b*, positioned in the liner's mounted state such that there is the line-of-sight 15*c*1 of FIG. 4′ or 15*c*2 of FIG. 4B. Additionally FIGS. 4A and 4B illustrate as a further element of this combination, a typical liner-securing structure 24*a* of FIGS. 4A and 234B. Additionally FIGS. 4A and 4B illustrate a further element of this combination, a typical liner-securing structure 24*a* of FIG. 4A and 24*b* of FIG. 4B, suspending the liner portion 23*aa* from the tank 10*a* and support structure 10*b*. The liner upright wall 23′ of FIG. 4A includes the aforestated liner portion 23*a*, liner bottom portion 23*c*, and the liner intermediate portion 23*a*. FIG. 4B liner 23″ has corresponding elements above-stated for liner 23′.

While FIG. 5 illustrates a typical necessary clamping structure and mechanism designated clamping device 24, it is a well known conventional device among many others that serve the same function, namely of anchoring the upper edge 23*aa* of the liner 23 onto the upper wall portion 10*aa* of a tank or support structure as the case may be. In the conventional manner, the clamping device has the upper u-shaped structure 23′ having opposite downwardly-extending legs 24′ and 24″ with their respective lower inwardly directed opposing flanges 24′*a* and 24′*b*. The downwardly extending leg 24′ overlaps an lower upper portion of the liner top-edge 23*aa* and therebeneath the downwardly-directed liner top-edge 23′*b*; the downwardly extending leg 24″ clamps against the turned-downwardly outer top portion 23′ of the liner 23*aa* and upwardly-directed turned-under liner portion 23′*a* that continues inwardly to become the aforenoted downwardly-directed liner top-edge 23′*b*. The downwardly extending leg 24″ has its inwardly-extending flange 24′*b* that wrap around the lower-most portion of the liner portion 23′ and 23′*a*, and the downwardly extending leg 24′ wraps around the inner aforenoted downwardly-extending liner top-edge 23′*b* and the upwardly extending liner portion 23*aa*.

Figure 6:
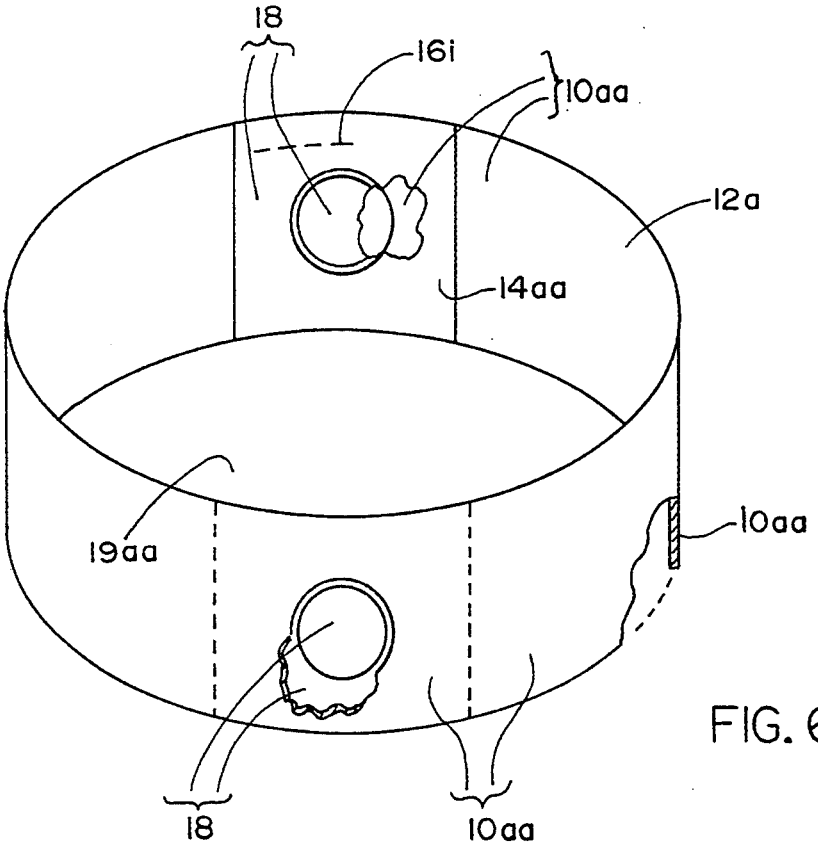

FIG. 6 diagrammatically and symbolically represents and illustrates for any one or mere of the structures illustrated in FIGS. 2A or 2B, as embodied in either of the embodiments of FIGS. 4A or 4B, in this illustration illustrating for the 2B and 4B support structure embodiment, a ..preferred circular cylindrical structure illustrates a reenforcing substantially squared member 18 located at-least below contemplated water-level 16*i* within a liner (not shown) to be mounted on the support structure that embodies sufficient strength and/or rigidity as to prevent the liner when mounted and when containing major amounts of liquid (typically water) from protruding through the aforestated through-space 14*aa* as a result of water pressure at the level of the through-space 14*aa* (window) in the upright wall 10*aa* as viewed through an illustrative drawing cut-away, the reenforcing member being translucent or transparent. In this Figure, it is further illustrated that there may be a plurality of windows provided for, each with its separate reinforcing structure. Such reinforcing may not be always needed for a shallow depth of liquid or water, or where for the contemplated depth the liner itself is of sufficient thickness and/or sturdiness and/or strength and/or rigidity as to obviate the need for additional transparent support at the through-space. Also, as formerly above-stated, the liner may have sufficient thick throughout its side walls and/or selectively at the contemplated positioning (location points) for window(s) (through-space(s)) in the support or tank wall, as to obviate the need of additional support against water or other liquid pressure at the location of the window (through-space).

Figure 7:
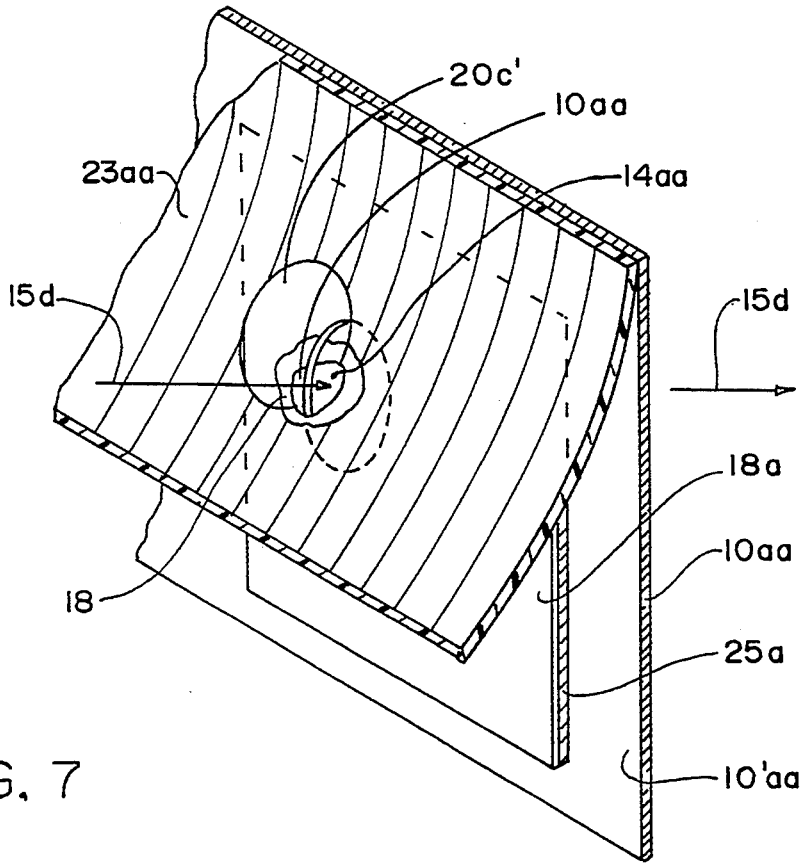

FIG. 7 as aforestated illustrated an alternate preferred embodiment for effecting additional support of the liner wall 23*aa* at the through-space 14*aa* of the tank or support wall 10*aa*, here shown in a side and top perspective view with a reenforcing transparent and/or translucent typical squared or rectangular member 18*a* here adhered to an inner surface of the tank or support structure wall 10*aa* by adhesive or cement 25*a*, to prevent the possibility of protrusion of the thinner liner 23*aa* (also illustrated an in-part view), when water contained and retained by the liner is sufficient to press the liner 23*aa* toward and against an inner surface 10′*aa* of the tank wall or of the support wall 10*aa*.

Figure 8:
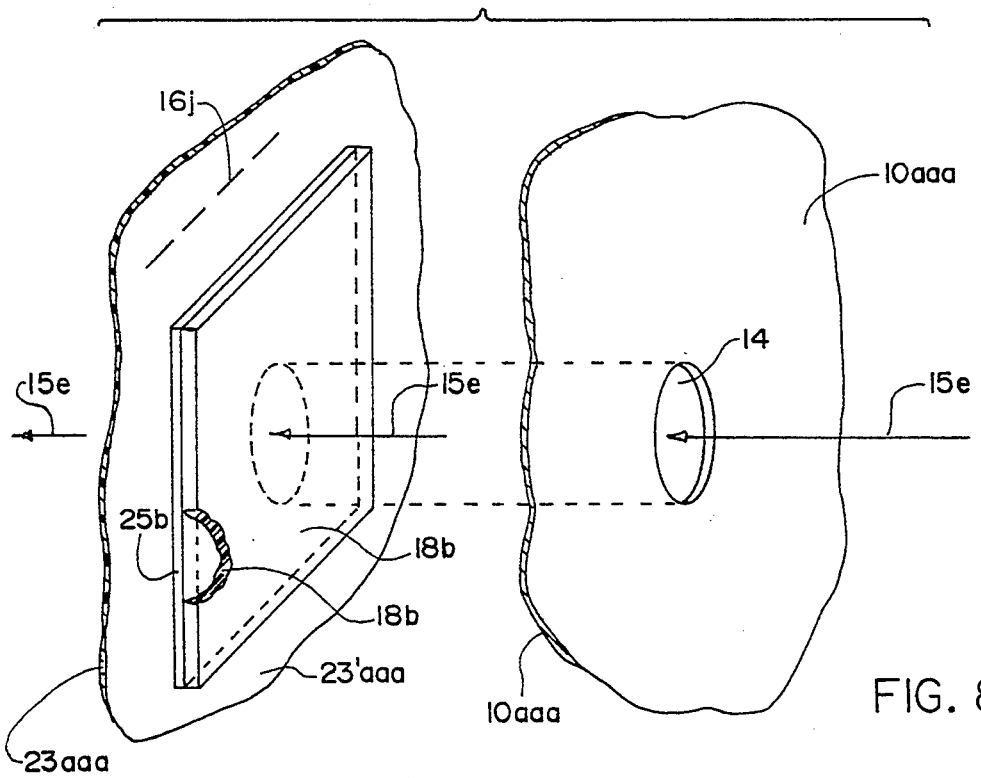

FIG. 8 in an exploded view diagrammatically and symbolically illustrates an alternate preferred embodiment as compared to that of FIG. 7, in this embodiment, the transparent or translucent sturdy member 18*b* being mounted on the outer surface 23′*aaa* of the liner 23*aaa* and positioned such that it will be aligned with the through-space opening 14 in the tank wall or support wall 10*aaa*. Thereby, any possibility of protrusion of a weak or non-rigid liner through the through-space opening 14 is prevented.

Figure 9:
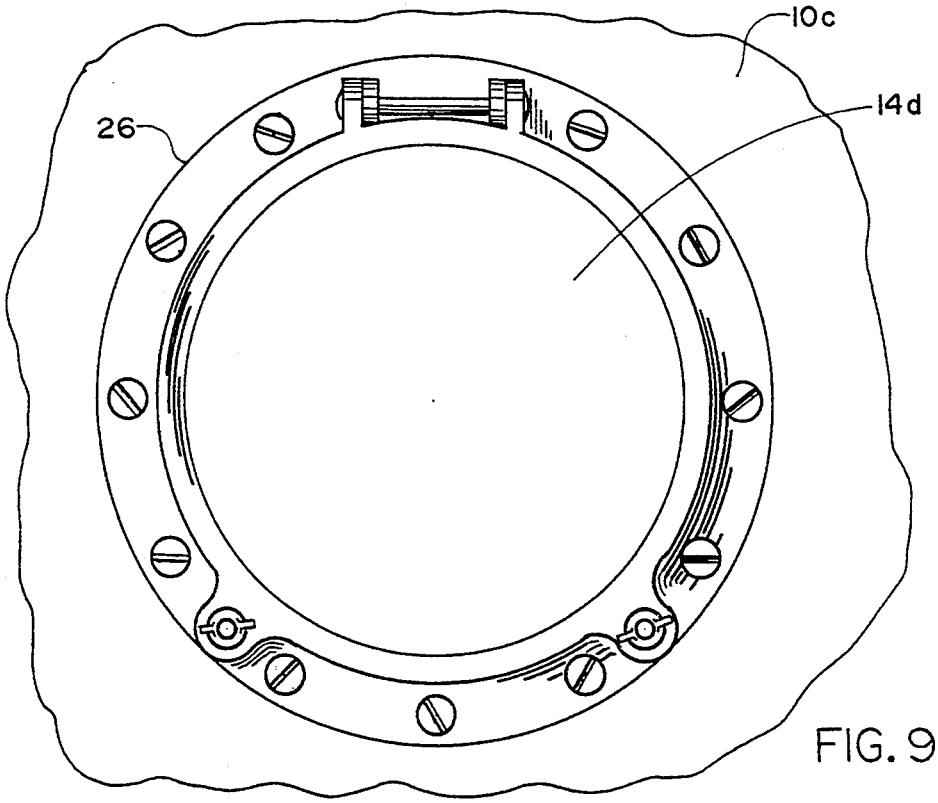

FIG. 9 diagrammatically and symbolically illustrates and represents an additional preferred embodiment on any one or more of preceding embodiments, in which the outer surface 10*c* of the tank or of the support wall 10*c*, include actual and/or painted or otherwise symbolic structure 26 resembling a ship's porthole circumscribing the through-space opening 14*d* in the wall of the tank or of the support structure, as the case may be, or alternatively painted on the liner (not shown) or an intermediate support structure (not shown) of the type(s) illustrated in foregoing FIGS. 7 or 8.

For the liner, typically any conventional or prior art or desired liner material may be employed/utilized provided it meets the aforestated requirements of strength, durability, based on being consistent with prior art known and conventional demands of such requirements. However, conventionally at this time, normally and preferably the liner is pooyvinylchloride, but may also be other appropriate materials such as canvas, laminated woven fabric conventionally available, and the like.

The tank wall and/or support structure such as for the above-ground pool for purposes of the invention will also depend upon the nature of the liquid weight to be supported thereby. Apart therefrom, the tank or support such as aforestated support structure of an above-ground pool may be typically any conventional metal heretofore normally used for such purpose—preferably stainless steel or the like but not limited thereto; also, particular plastics may be utilized in-part or in whole, such as polyvinylchloride, and/or polystyrene, polypropylene, and/or acrylic. The preferred material being prefably primarily metal.

For purposed of use in an above-ground swimming, the shape of the liner may be any convenient or desired shape such as normall round or oval, but also squared, rectangular, and the like, of a typical size ranging from 12 to 18 feet in width, up to about 45 feet in length, and typically conventionally has a liner thickness ranging from 6 mils to about 20 mils, except the reinforcing member or liner portion normally would range in thickness from abut ⅛ inch up to about 1 inch, preferably from about ¼ inch up to about ½ inch. The aforestated through space or window in the tank or support wall is typically a minimum of 1 inch up to a maximum of about 48 inches, typically ranging from about six inches up to about eighteen inches in diameter, where round—as symbolic of a porthold. The length and/or width of such through space for a non-round or non-oval through-space or window, typically ranges from about 1 inch square to a width of from about two feet, and a length of from about 1 inch up to about three feet, preferably a width of from abut six inches to abut one foot, and a length of from about six inches to about two feet.

It is with the scope of the invention to make such variations as would be apparent to a person of ordinary skill in this particular art.

I claim:

1. In a swimming pool in a combination of: A) upright substantially rigid walls a) extending above ground level with the upright walls at least substantially circumscribing pool water retainable liner-space, and b) having upper portions, c) having water containable vessel liner securing means anchoring upper circumscribing portions of a swimming pool liner at said wall upper portions of the upright walls, and d) including at-least one through-space window-like opening through said walls; and B) said swimming pool liner a) having a bottom portion and b) having a circumscribing liner wall that is substantially uprightly extendable with (i) a liner lower wall portion thereof continuous with said bottom portion, (ii) a liner upper portion thereof securable by said water containable vessel liner securing means such that said uprightly extendable circumscribing liner wall is supported at a height above a predetermined intended water level containable within said water containable vessel liner, and (iii) an intermediate liner wall portion between said liner lower wall portion and said liner upper portion, the improvement comprising: said intermediate liner wall portion having a part being at least translucent; and 2) said through-space window-like opening being positionable to be alignable with said part at a predetermined elevation such that there exists a line of sight through both of said through-space window-like opening and said part.

2. The combination and improvement of claim 1, in which said part is of a shape and is of an area substantially the same as said through-space window-like opening.

3. The combination and improvement of claim 1, in which said part includes at-least a major proportion of said intermediate liner wall portion.

4. The combination and improvement of claim 1, in which said each of said part and said through-space window-like opening are shaped substantially as a ship porthole.

5. The combination and improvement of claim 4, in which said part is transparent.

6. The combination and improvement of claim 5, in which in said rigid walls, said through-space window-like opening has opposite spaced-apart edges spaced-apart a distance ranging from about one inch up to about forty-eight inches.

7. The combination and improvement of claim 6, in which said distance ranges from about six inches up to about twenty-four inches.

8. The combination and improvement of claim 7, including a see-through substantially rigid support structure positioned and mounted substantially flatly between said part and said rigid walls and in alignment with and over said through-space window-like opening such that support is provided sufficiently to avoid significant protrusion of said part through said through-space window-like opening when water is retained by said swimming pool liner.

9. The combination and improvement of claim 4, including a framing structure on said intermediate liner wall portion at said through-space window-like opening positioned and structured to impart an impression of and resemblance to a porthole.

10. The combination and improvement of claim 4, in which in said rigid walls, said through-space window-like opening has opposite spaced-apart edges spaced-apart a distance ranging from about one inch up to about forty-eight inches.

11. The combination and improvement of claim 4, including decorative matter on said intermediate liner wall portion at said through-space window-like opening positioned and structured to impart an impression of and resemblance to a porthole.

12. The combination and improvement of claim 1, in which in said rigid walls, said through-space window-like opening has opposite spaced-apart edges spaced-apart a distance ranging from about one inch up to about forty-eight inches.

13. The combination and improvement of claim 12, in which said distance ranges from about six inches up to about twenty-four inches.

14. The combination and improvement of claim 1, in which said part is transparent.

15. The combination and improvement of claim 1, including a framing structure on said intermediate liner wall portion at said through-space window-like opening positioned and structured to impart an impression of and resemblance to a porthole.

16. The combination and improvement of claim 1, including a see-through substantially rigid support structure positioned and mounted substantially flatly between said part and said rigid walls and in alignment with and over said through-space window-like opening such that support is provided sufficiently to avoid significant protrusion of said part through said through-space window-like opening when water is retained by said swimming pool liner.

17. The combination and improvement of claim 1, including decorative matter on said intermediate liner wall portion at said through-space window-like opening positioned and structured to impart an impression of and resemblance to a porthole.

18. In a liquid containing structure in a combination of: A) upright substantially rigid walls a) extending above ground level with the upright walls at least substantially circumscribing liquid retainable liner-space, b) having upper portions, c) water containable vessel liner securing means anchoring upper circumscribing portions of a liquid retaining vessel liner at said wall upper portions of the upright walls, and d) including at-least one through-space window-like opening through said walls; and B) said liquid retaining vessel liner a) having a bottom portion and b) having a circumscribing liner wall that is substantially uprightly extendable with (i) a liner lower wall portion thereof continuous with said bottom portion, (ii) a liner upper portion thereof securable by said liquid retaining vessel liner securing means such that said uprightly extendable circumscribing liner wall is supported at a height above a predetermined intended liquid level containable within said liquid retainer liner, and (iii) an intermediate liner wall portion between said liner lower wall portion and said liner upper portion, the improvement comprising: said intermediate liner wall portion having a part being at least translucent; and 2) said through-space window-like opening being positionable to be alignable with said part at a predetermined elevation such that there exists a line of sight through both of said through-space window-like opening and said part.

* * * * *